US012656008B2

(12) United States Patent
Nicolas et al.

(10) Patent No.: US 12,656,008 B2
(45) Date of Patent: Jun. 16, 2026

(54) METHOD FOR CONTROLLING A THERMAL CONDITIONING SYSTEM

(71) Applicant: VALEO SYSTEMES THERMIQUES, Le Mesnil-Saint-Denis (FR)

(72) Inventors: Bertrand Nicolas, Le Mesnil-Saint-Denis (FR); Mohamed Yahia, Le Mesnil-Saint-Denis (FR)

(73) Assignee: VALEO SYSTEMES THERMIQUES, Le Mesnil-Saint-Denis (FR)

( * ) Notice: Subject to any disclaimer, the term of this patent is extended or adjusted under 35 U.S.C. 154(b) by 40 days.

(21) Appl. No.: 18/880,102

(22) PCT Filed: Jun. 20, 2023

(86) PCT No.: PCT/EP2023/066556
§ 371 (c)(1),
(2) Date: Dec. 30, 2024

(87) PCT Pub. No.: WO2024/002776
PCT Pub. Date: Jan. 4, 2024

(65) Prior Publication Data

US 2025/0257893 A1 Aug. 14, 2025

(30) Foreign Application Priority Data

Jun. 29, 2022 (FR) ..... 2206497

(51) Int. Cl.
*F24F 11/63* (2018.01)

(52) U.S. Cl.
CPC ..... *F24F 11/63* (2018.01)

(58) Field of Classification Search
CPC ..... F24F 11/63; F24F 2140/50; F24F 11/46; F24F 2140/60; B60H 2001/00949; B60H 1/32281; F25B 5/02
See application file for complete search history.

(56) References Cited

U.S. PATENT DOCUMENTS 5,009,077 A * 4/1991 Okoshi ..... F25B 41/20 62/174
10,384,511 B2 8/2019 Porras et al.
(Continued)

FOREIGN PATENT DOCUMENTS

CN 108357333 A 8/2018
CN 110678342 A 1/2020
(Continued)

OTHER PUBLICATIONS

International Search Report in corresponding International Application No. PCT/EP2023/066556, dated Sep. 29, 2023 (6 pages).
(Continued)

*Primary Examiner* — Nelson J Nieves
(74) *Attorney, Agent, or Firm* — Osha Bergman Watanabe & Burton LLP

(57) ABSTRACT

Disclosed is a method for controlling a thermal conditioning system includes a heat-transfer liquid circuit, a refrigerant circuit having a compressor, a first heat exchanger supplying a first thermal power to a heat-transfer fluid, a first expansion valve, a second heat exchanger supplying a second thermal power to the heat-transfer liquid, a second expansion valve, and a third heat exchanger. The control method includes receiving a total thermal power setpoint for the total thermal power that is to be supplied, controlling a pressure of the refrigerant in the first exchanger so that the total thermal power supplied is equal to the total thermal power setpoint, and controlling a flow area of the first expansion valve so that the second thermal power supplied is equal to the second thermal power setpoint.

12 Claims, 4 Drawing Sheets

(56) References Cited

U.S. PATENT DOCUMENTS

| | | | | |
|---|---|---|---|---|
| 2012/0179329 | A1* | 7/2012 | Okamoto | B60H 1/00899 701/36 |
| 2014/0123692 | A1* | 5/2014 | McSweeney | F25B 49/02 62/115 |
| 2014/0150483 | A1* | 6/2014 | Takayama | F25B 30/02 62/160 |
| 2017/0182867 | A1* | 6/2017 | Durrani | B60H 1/00342 |
| 2022/0275987 | A1* | 9/2022 | Gao | F25B 49/02 |
| 2023/0023466 | A1* | 1/2023 | Harihara Gupta | B60L 1/003 |
| 2023/0031154 | A1* | 2/2023 | Yahia | B60H 1/00278 |
| 2024/0123789 | A1* | 4/2024 | Li | B60H 1/143 |
| 2024/0353156 | A1* | 10/2024 | Vaisman | F25B 41/28 |
| 2025/0010283 | A1* | 1/2025 | Zahrt | F25B 49/02 |
| 2025/0074146 | A1* | 3/2025 | Heo | B60H 1/00842 |
| 2025/0083494 | A1* | 3/2025 | Li | B60H 1/3207 |

FOREIGN PATENT DOCUMENTS

| | | | |
|---|---|---|---|
| CN | 111788080 | A | 10/2020 |
| CN | 112313099 | A | 2/2021 |
| FR | 3110878 | A1 | 12/2021 |
| WO | 2019135049 | A1 | 7/2019 |
| WO | 2021239759 | A1 | 12/2021 |

OTHER PUBLICATIONS

Written Opinion in corresponding International Application No. PCT/EP2023/066556, dated Sep. 29, 2023 (6 pages).

Office Action Issued in Corresponding CN Application No. 202380050718.9, dated Apr. 13, 2025 (10 Pages with English Translation).

* cited by examiner

METHOD FOR CONTROLLING A THERMAL CONDITIONING SYSTEM

TECHNICAL FIELD

The present invention relates to the field of thermal conditioning systems. Thermal conditioning systems of this type can in particular equip a motor vehicle. These systems make it possible to carry out thermal regulation of different parts of the vehicle, such as the passenger space or an electrical energy storage battery, when the traction chain of the vehicle is electrical. The exchanges of heat are controlled mainly by the compression and expansion of a coolant fluid within a plurality of heat exchangers.

PRIOR ART

Thermal conditioning systems commonly use a coolant fluid circuit and a heat-transfer liquid circuit which exchanges heat with the coolant fluid. Such systems are thus referred to as indirect. A compressor assures the passage of the coolant fluid at a high pressure.

It is known to position in series in the coolant fluid circuit a first heat exchanger which makes it possible to assure the heating of a flow of air destined for the passenger space of the vehicle, a second heat exchanger which makes it possible to heat an element of the traction chain of the vehicle, and a third heat exchanger which makes it possible to cool this element of the traction chain of the vehicle. The element of the traction chain is for example an electrical energy storage battery. The second exchanger and the third exchanger are for example positioned jointly on the coolant fluid circuit and on a heat-transfer liquid circuit. The heat-transfer liquid circulating in the circuit makes it possible to assure a thermal exchange with the element of the traction chain. According to the operating modes, it is thus possible to supply heat to the element of the traction chain of the vehicle in order to heat it, or to recuperate heat from this element, in order to transfer it for example to the flow of air supplying the passenger space, in order to heat it. In a particular operating mode, the air of the passenger space is heated by the first heat exchanger, and heating of the heat-transfer liquid is simultaneously assured at the second heat exchanger.

The total thermal power supplied by the thermal conditioning system is thus distributed between a first thermal power supplied by the first exchanger, and a second thermal power supplied by the second exchanger. Assuring precise control of the thermal power supplied by each of the exchangers is problematic.

The objective of the present disclosure is to propose a control method which makes it possible to control reliably the total thermal power supplied and its distribution between the two heat exchangers.

SUMMARY

For this purpose, the present invention proposes a method for controlling a thermal conditioning system, the thermal conditioning system comprising:

- a heat-transfer liquid circuit which is configured to circulate a heat-transfer liquid;
- a coolant fluid circuit comprising in succession in a direction of flow of the coolant fluid:
  - a compressor;
  - a first heat exchanger which is configured to supply a first thermal power to a heat-transfer fluid;
  - a first expansion valve;

- a second heat exchanger arranged jointly on the coolant fluid circuit and on the heat-transfer liquid circuit, so as to supply a second thermal power to the heat-transfer liquid;
  - a second expansion valve;
  - a third heat exchanger;

the control method comprising the steps of:

(i) Receiving a total thermal power set point to be supplied, the total thermal power set point being the sum of a first thermal power set point to be supplied to the heat-transfer liquid in the first exchanger, and a second thermal power set point to be supplied to the heat-transfer liquid in the second exchanger; (ii) Controlling a pressure of the coolant fluid in the first exchanger, such that the sum of the first thermal power supplied and the second thermal power supplied is equal to the total thermal power set point to be supplied; and (iii) Controlling a cross-section of passage of the first expansion valve such that the second thermal power supplied by the second exchanger is equal to the second thermal power set point to be supplied.

In the step (iii), the first expansion valve carries out partial expansion of the coolant fluid, such that the second thermal power supplied by the second exchanger is equal to the second thermal power set point to be supplied.

This partial expansion makes it possible to decrease the condensation temperature in the second heat exchanger, and thus to adjust the distribution of the total thermal power supplied between the power supplied to the first exchanger and the power supplied to the second exchanger. The desired distribution can be obtained.

The characteristics listed in the following paragraphs can be implemented independently from one another or according to all the combinations technically possible:

According to one embodiment, the thermal conditioning system is a thermal conditioning system for a motor vehicle.

The cross-section of passage of the first expansion valve is controlled by a proportional integral regulator.

The cross-section of passage of the second expansion valve is controlled by a proportional integral regulator.

This type of regulator assures reliable regulation, while remaining simple to program and to adjust.

According to one embodiment of the method, the step (ii) comprises the following sub steps:

(ii1) Determining a temperature set point of the coolant fluid in the first exchanger from the first thermal power set point and from a set point of flow of the heat-transfer liquid; (ii2) Determining a pressure set point of the coolant fluid in the first exchanger from the temperature set point determined.

Preferably, in the step (ii1), the temperature set point of the coolant fluid in the first exchanger is also determined from an input temperature of the coolant fluid in the first exchanger.

According to an aspect of the control method, the step (ii) comprises the following sub-step:

(ii3) Controlling a speed of rotation of the compressor, such that the pressure of the coolant fluid in the first exchanger is equal to the pressure set point determined.

The pressure of the coolant fluid in the first exchanger can be measured by a measurement sensor positioned at the input of the first exchanger.

The compressor is configured to make the coolant fluid go from an aspiration pressure to a delivery pressure.

According to an aspect of the control method, in which the compressor is configured to make the coolant fluid go from an aspiration pressure to a delivery pressure, the step (i) comprises the following sub-step:

(i3) Determining a delivery pressure set point of the compressor from the pressure set point determined of the coolant fluid in the first exchanger.

According to an aspect of the control method, the step (ii) comprises the following sub-step:

(ii1) Controlling a speed of rotation of the compressor, such that the delivery pressure of the compressor is equal to the delivery pressure set point determined.

According to an embodiment of the method, the pressure of the coolant fluid in the first exchanger is substantially equal to the delivery pressure of the compressor.

The pressure of the coolant fluid in the first exchanger is for example estimated from a measured value of the delivery pressure of the compressor.

According to an embodiment of the method, the heat-transfer fluid is a flow of air inside a passenger space of a motor vehicle.

According to another embodiment of the method, the heat-transfer liquid is a heat-transfer liquid which is configured to circulate in a fifth heat exchanger configured to exchange heat with a flow of air inside the passenger space of the vehicle.

According to an aspect of the method, the second heat exchanger is coupled thermally with an element of a traction chain of the vehicle, by means of the heat-transfer liquid of the heat-transfer liquid circuit.

The second heat exchanger thus makes it possible to supply thermal power to the element of the traction chain of the vehicle, i.e. to heat this element in order to increase its temperature.

According to an embodiment of the method, the third heat exchanger is coupled thermally with the element of a traction chain of the vehicle, by means of the heat-transfer liquid of the heat-transfer liquid circuit.

The third heat exchanger thus makes it possible to absorb heat from the element of the traction chain of the vehicle, in order to maintain its temperature within an acceptable limit, or in order to transfer the heat absorbed to another unit.

The element of the electrical traction chain comprises for example an electric traction motor of the vehicle.

As a variant, or in a complementary manner, the element of the electric traction chain comprises an electronic module for controlling an electric traction motor of the vehicle.

Also as a variant, or in a complementary manner, the element of the electric traction chain comprises an electrical energy storage battery.

The invention also relates to a thermal conditioning system comprising:

- a heat-transfer liquid circuit which is configured to circulate a heat-transfer liquid;
- a coolant fluid circuit comprising:
  - a main loop, comprising in succession in a direction of flow of the coolant fluid:
    - a compressor;
    - a first heat exchanger which is configured to supply a first thermal power to a heat-transfer liquid;
    - a first expansion valve;
    - a second heat exchanger which is arranged jointly on the coolant fluid circuit and on the heat-transfer liquid circuit, so as to supply a second thermal power to the heat-transfer liquid;
    - a second expansion valve;
    - a third heat exchanger;
- an electronic control unit which is configured to implement the control method previously described.

According to one embodiment, the main coolant fluid loop comprises a coolant fluid accumulation device positioned downstream from the second exchanger and upstream from the second expansion valve.

According to another embodiment, the main coolant fluid loop comprises a coolant fluid accumulation device positioned downstream from the third exchanger and upstream from the compressor.

According to one embodiment of the thermal conditioning system, the coolant fluid circuit comprises a first branch positioned in parallel with the second expansion valve and the third heat exchanger, with the first branch comprising a third expansion valve and a fourth heat exchanger.

The thermal conditioning system comprises a first branch which connects fluidically a first connection point positioned on the main loop downstream from the second exchanger and upstream from the second expansion valve, to a second connection point positioned on the main loop downstream from the third exchanger and upstream from the compressor, with the first branch comprising a third expansion valve.

According to one embodiment of the thermal conditioning system, the fourth heat exchanger is configured to exchange heat with a flow of air inside the passenger space of the vehicle.

According to one embodiment, the coolant fluid circuit comprises a second branch which allows coolant fluid at the output from the compressor to reach the third exchanger by bypassing the first exchanger, the second exchanger and the second expansion valve, with the second branch comprising a fourth expansion valve.

The thermal conditioning system comprises a second branch which connects fluidically a third connection point positioned on the main loop downstream from the compressor and upstream from the first exchanger, to a fourth connection point positioned on the main loop downstream from the second expansion valve and upstream from the third exchanger, with the second branch comprising a fourth expansion device.

According to one embodiment, in which the main loop of the coolant fluid circuit comprises a fifth expansion valve positioned downstream from the compressor and upstream from the first exchanger, the coolant fluid is expanded by the fifth expansion valve, and the pressure of the coolant fluid which exists in the first exchanger is lower than the delivery pressure of the compressor.

The pressure of the coolant fluid in the first exchanger is estimated from a measured value of the pressure of the coolant fluid at the output from the fifth expansion valve.

BRIEF DESCRIPTION OF THE DRAWINGS

Other characteristics, details and advantages will become apparent from reading the following detailed description, and analyzing the appended drawings, in which.

DESCRIPTION OF THE EMBODIMENTS

Figure 1:
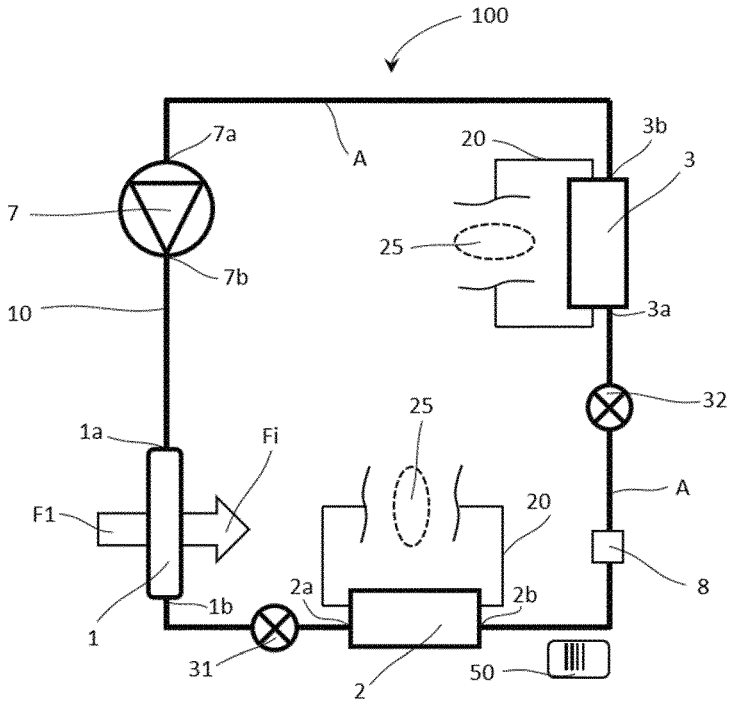
FIG. 1 is a schematic view of a thermal conditioning system according to a first embodiment, in which the control method according to the invention is implemented.

In order to make the figures easier to read, the different elements are not necessarily shown to scale. In these figures, elements which are identical bear the same references. Certain elements or parameters can be indexed, i.e. designated for example by a first element or second element, or also a first parameter and a second parameter, etc. The purpose of this indexing is to differentiate elements or parameters which are similar but not identical. This indexing does not imply priority of one element or parameter in relation to another, and the denominations can be interchanged.

In the following description, the term "a first element upstream from the second element" means that the first element is placed before the second element in relation to the direction of circulation or travel of a fluid. Similarly, the expression "a first element downstream from a second element" means that the first element is placed after the second element in relation to the direction of circulation or travel of the fluid in question. In the case of the coolant fluid circuit, the term "a first element is upstream from the second element" means that the coolant fluid travels in succession along the first element then the second element, without passing via the compression device. In other words, the coolant fluid exits from the compression device, passes through one or optionally a plurality of elements, then passes through the first element, then the second element, then returns to the compression device, optionally after having passed through other elements.

The term "a second element is placed between a first element and a third element" means that the shortest path for traveling from the first element to the third element passes via the second element.

When it is specified that a sub-system comprises a given element, this does not rule out the presence of other elements in this sub-system.

In the thermal conditioning system 100 described, an electronic control unit 50 receives information from various sensors, not shown, measuring in particular the characteristics of the coolant fluid at various points on the circuit. The electronic control unit also receives set points issued by the occupants of the vehicle, such as the desired temperature inside the passenger space for example. The electronic control unit implements control laws permitting control of the different actuators, in order to control the thermal conditioning system 100 so as to assure the set points received. The electronic control unit 50 in particular implements the method according to the invention.

The compression device 7 can be an electric compressor, i.e. a compressor, the movable parts of which are driven by an electric motor. The compression device 7 comprises a side for aspiration of the coolant fluid at low pressure, also known as the input 7*a* of the compression device, and a side for delivery of the coolant fluid at high pressure, also known as the output 7*b* of the compression device 7. The compressor 7 is configured to make the coolant fluid go from an aspiration pressure Pr_s to a delivery pressure Pr_d.

The aspiration pressure is a so-called low-pressure state, and the delivery pressure is a so-called high-pressure state. The movable parts inside the compressor 7 make the coolant fluid change from the low-pressure state on the input side 7*a*, to the high-pressure state on the output side 7*b*. After expansion in one or more expansion devices, the coolant fluid returns to the input 7*a* of the compressor 7 and begins a new thermodynamic cycle.

The coolant fluid circuit 10 forms a closed circuit in which the coolant fluid can circulate. The coolant fluid circuit 10 is sealed when it is in a nominal operating state, i.e. without a fault or leakage. Each connection point of the circuit 10 allows the coolant fluid to enter one or other of the circuit portions that meet at this connection point. The coolant fluid is distributed between the circuit portions meeting at a connection point by adjusting the opening or closure of stop valves, non-return valves or an expansion device included on each of the branches. In other words, each connection point is a means for redirecting the coolant fluid arriving at this connection point. Stop valves and the non-return valves thus make it possible to direct the coolant fluid selectively into the different branches of the coolant fluid circuit, in order to assure different operating modes, as will be described hereinafter.

The coolant fluid used by the coolant fluid circuit 1 is in this case a chemical fluid such as R1234yf. Other coolant fluids can also be used, such as, for example, R134a, R290 or R744.

"Inside flow of air Fi" means a flow of air destined for the passenger space of the motor vehicle. This inside flow of air can circulate in an installation for heating, ventilation and/or air conditioning often designated by the term "HVAC". This installation is not shown in the various figures.

FIG. 1 represents a first embodiment of a thermal conditioning system 100 comprising:

- a heat-transfer liquid circuit 20 configured to circulate a heat-transfer liquid;
- a coolant fluid circuit 10 comprising:
  - a main loop A comprising in succession in the direction of flow of the coolant fluid:
    - a compressor 7;
    - a first heat exchanger 1, which is configured to supply a first thermal power Pw1 to a heat-transfer liquid F1;
    - a first expansion valve 31;
    - a second heat exchanger 2 which is arranged jointly on the coolant fluid circuit 10 and on the heat-transfer liquid circuit 20, so as to supply a second thermal power Pw2 to the heat-transfer liquid;
    - a second expansion valve 32;
    - a third heat exchanger 3;
- an electronic control unit 50, which is configured to implement a control method which will be described in detail hereinafter.

The first heat exchanger 1 is configured to exchange heat with the heat-transfer liquid F1. The first heat exchanger 1 can operate as a condenser. The condensation heat of the coolant fluid is transferred to the heat-transfer liquid F1. A thermal power, designated as the first thermal power Pw1, is thus supplied to the heat-transfer liquid F1.

The first thermal power Pw1 supplied is the thermal power supplied by the coolant fluid to the heat-transfer liquid F1 within the first heat exchanger 1.

The second heat exchanger 2 is a bi-fluid exchanger. In other words, the second heat exchanger 2 comprises a first compartment through which the coolant fluid passes, and a second compartment through which the heat-transfer liquid passes. The two compartments are sealed, and can carry out a thermal exchange. The bi-fluid exchanger 2 comprises an input 2*a* and an output 2*b* for coolant fluid, as well as an input and an output for heat-transfer liquid, which are not numbered in the illustrative figures. The second exchanger 2 is for example a plate exchanger.

Like the first exchanger 1, the second exchanger 2 can operate as a condenser. The condensation heat of the coolant fluid can be transferred to the heat-transfer liquid circulating in the second exchanger 2.

The second thermal power Pw2 supplied is the thermal power supplied by the coolant fluid to the heat-transfer liquid of the heat-transfer liquid circuit 20 within the second heat exchanger 2.

The third heat exchanger 3 is also a bi-fluid exchanger.

Each expansion valve is a device for expansion of the coolant fluid. Each expansion valve makes it possible to adjust the level of expansion undergone by the coolant fluid while passing through this expansion valve. Each expansion valve is configured to vary a cross-section of passage of the coolant fluid. "Cross-section of passage" means the surface area through which the coolant fluid flows when passing through the expansion valve.

Each expansion valve comprises a coolant fluid input and a coolant fluid output. The output and input are connected fluidically by a channel. A mobile shutter makes it possible to control the cross-section of passage of the channel, i.e. the surface area of passage provided for the coolant fluid. The expansion valve is for example an electronic expansion valve, i.e. the mobile shutter is actuated by an electric motor controlled by an electronic control unit. The position of the mobile shutter can be controlled in a closed loop, i.e. the position of the mobile shutter is measured and adjusted in real time such as to obtain a position set point. The cross-section of passage of the coolant fluid can be adjusted continuously between a position of closure and a position of maximum opening. The electronic control module of each expansion valve can be incorporated in the corresponding expansion valve. According to a variant, the electronic control unit 50 can also assure the command and control of each expansion valve.

According to the embodiment illustrated here, the thermal conditioning system 100 is a thermal conditioning system for a motor vehicle.

In the embodiment of FIG. 1, the heat-transfer liquid F1 is a flow of interior air Fi to a passenger space of a motor vehicle. The first heat exchanger 1 is positioned in the heating, ventilation and/or air conditioning installation. The first exchanger 1 thus makes it possible to heat the passenger space of the vehicle.

The second heat exchanger 2 is coupled thermally with an element 25 of a traction chain of the vehicle, by means of the heat-transfer liquid of the heat-transfer liquid circuit 20. The second heat exchanger 2 thus makes it possible to supply thermal power to the element 25 of the traction chain of the vehicle, i.e. to heat this element in order to increase its temperature. The heating of the element 25 of the traction chain, for example an electrical energy storage battery, can be put into use for example during the phase of putting the vehicle into action, by means of a negative ambient temperature.

In other words, the heat-transfer liquid which circulates in the heat-transfer liquid circuit 20 carries out a thermal exchange with the element 25 of the traction chain of the vehicle, which permits an exchange of heat between the element 25 and the second heat exchanger 2, i.e. a thermal coupling. The heat-transfer liquid is for example a mixture of water and glycol. The heat-transfer liquid can also be a dielectric liquid, i.e. an electrically insulating liquid.

The element 25 of the electric traction chain comprises for example an electric traction motor of the vehicle. As a variant, or in a complementary manner, the element 25 of the electric traction chain comprises an electrical energy storage battery. Also as a variant, or in a complementary manner, the element 25 of the electric traction chain comprises an electronic module for controlling an electric traction motor of the vehicle.

The third heat exchanger 3 is coupled thermally with the element 25 of the traction chain of the vehicle, by means of the heat-transfer liquid of the heat-transfer liquid circuit 20.

The third heat exchanger 3 thus makes it possible to absorb heat from the element 25 of the traction chain of the vehicle, in order to maintain its temperature within an acceptable limit, or in order to transfer the heat absorbed to another unit. The combined action of the second exchanger 2 and the third exchanger 3 makes it possible to assure thermal conditioning of the element 25 of the traction chain according to various operating modes. The heat-transfer liquid circuit 20 has not been described in detail, and is represented by broken lines at the third exchanger 3 and the second exchanger 2. In order to simplify the representation, and avoid intersections between the lines of the different circuits, the circuit 20 is represented in two distinct parts.

The heat-transfer liquid circuit 20 comprises at least one circulation pump, not represented, making it possible to make the heat-transfer liquid circulate in the circuit 20.

According to the embodiment of FIG. 1, the main loop A of coolant fluid comprises a device 8 for accumulation of coolant fluid positioned downstream from the second exchanger 2 and upstream from the second expansion valve 32. The device 8 for accumulation of coolant fluid is a dehydrating cylinder. The accumulation device 8 makes it possible to compensate for the variations of the mass of coolant fluid circulating in the circuit 10, according to the operating modes of the thermal conditioning system 100.

One of the possible operating modes of the thermal conditioning system is a mode in which the coolant fluid supplies heat to the heat-transfer liquid F1 at the first exchanger 1, supplies heat to the heat-transfer liquid at the second exchanger 2, and receives heat at the third exchanger 3. The heat-transfer liquid F1 receives a first thermal power Pw1 at the first exchanger 1, and the heat-transfer liquid receives a second thermal power Pw2 at the second exchanger 2. During the operation of the thermal conditioning system 100, it is desirable to be able to vary these two powers Pw1, Pw2 independently from one another. In other words, for a given total power, it is desirable to be able to adjust the distribution of this total power between the first power Pw1 and the second power Pw2.

The present invention thus proposes a method for controlling a thermal conditioning system 100, the thermal conditioning system 100 comprising:

- a heat-transfer liquid circuit 20 which is configured to circulate a heat-transfer liquid;
- a coolant fluid circuit 10 comprising in succession in a direction of flow of the coolant fluid:
  - a compressor 7;
  - a first heat exchanger 1 which is configured to supply a first thermal power Pw1 to a heat-transfer liquid F1;
  - a first expansion valve 31;
  - a second heat exchanger 2 which is arranged jointly on the coolant fluid circuit 10 and on the heat-transfer liquid circuit 20 so as to supply a second thermal power Pw2 to the heat-transfer liquid;

a second expansion valve 32;

a third heat exchanger 3.

The control method comprises the following steps:

(i) Receiving a total thermal power set point C_Pw to be supplied, the total thermal power set point C_Pw to be supplied being the sum of a first thermal power set point C_Pw1 to be supplied to the heat-transfer liquid F1 in the first exchanger 1, and a second thermal power set point C_Pw2 to be supplied to the heat-transfer liquid in the second exchanger 2; (ii) Controlling a pressure of the coolant fluid in the first exchanger 1, such that the sum of the first thermal power Pw1 supplied and the second thermal power Pw2 supplied is equal to the total thermal power set point C_Pw to be supplied; and—(iii) Controlling a cross-section of passage of the first expansion valve 31, such that the second thermal power Pw2 supplied by the second exchanger 2 is equal to the second thermal power set point C_Pw2 to be supplied.

In the step (iii), the first expansion valve 31 carries out partial expansion of the coolant fluid, such that the second thermal power Pw2 supplied by the second exchanger 2 is equal to the second thermal power set point C_Pw2 to be supplied.

This partial expansion makes it possible to decrease the condensation temperature in the second heat exchanger 2, and thus to adjust the distribution of the total thermal power supplied between the power supplied to the first exchanger 1 and the power supplied to the second exchanger 2. The desired distribution can be obtained.

The total power set point C_Pw as well as the first C_Pw1 and the second C_Pw2 thermal power set point can be processed in different ways.

For example, a total thermal power set point C_Pw can be emitted, with a distribution set point between the first and the second thermal powers. In other words, the total power to be supplied is known, as is the fraction of this total power which must be allocated to the first thermal power Pw1 and to the second thermal power Pw2.

Alternatively, a first set point C_Pw1 can be received directly for the first thermal power, as can a second set point C_Pw2 for the second thermal power.

Figure 5:
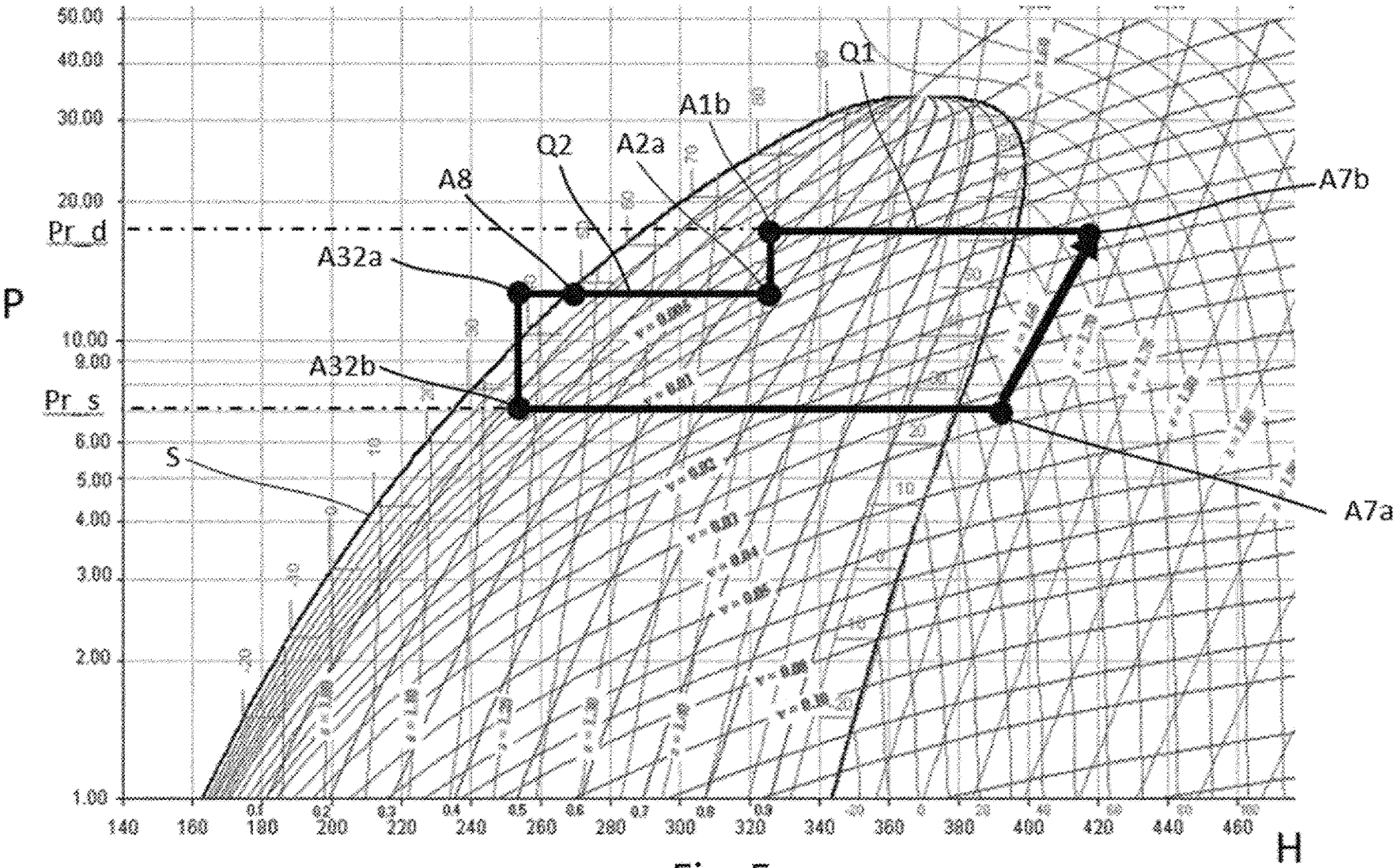
FIG. 5 is a thermodynamic diagram schematizing the state of the coolant fluid during implementation of the control method.
Figure 6:
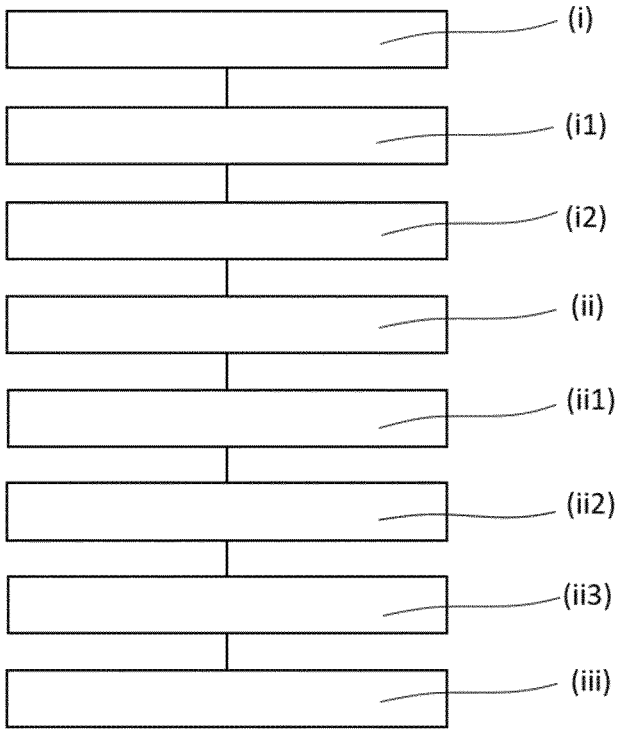
FIG. 6 is a block diagram illustrating different steps of the method according to the invention.

FIG. 5 illustrates the operation of the thermal conditioning system 100 of FIG. 1, when the method described here is implemented.

This figure illustrates the thermodynamic state of the coolant fluid during the thermodynamic cycle described. The value on the x-axis is the enthalpy H of the coolant fluid. The value on the y-axis is the pressure P of the coolant fluid on a logarithmic scale. The curve S is the characteristic saturation curve of the coolant fluid used. The region of the diagram contained between the saturation curve S and the y-axis corresponds to the biphasic field of the coolant fluid.

The point A7*a* represents the state of the coolant fluid at the input 7*a* of the compressor 7. The pressure of the coolant fluid there is equal to the aspiration pressure Pr_s. The point A7*b* represents the state of the coolant fluid at the output 7*b* from the compressor 7. The pressure there is equal to the delivery pressure Pr_d.

The enthalpy and the pressure of the coolant fluid at the input of the first exchanger 1 are substantially equal to those of point A7*b*. The point A1*b* represents the state of the coolant fluid at the output 1*b* from the first exchanger 1. The difference of enthalpy between the input 1*a* and the output 1*b* of the first exchanger 1, marked by the reference Q1, is representative of the first thermal power Pw1 supplied. The first expansion valve 31 carries out partial expansion of the coolant fluid, such that the pressure of the coolant fluid in the second exchanger 2 is lower than the pressure of the coolant fluid in the first exchanger 1. Point A2*a* schematizes the state of the coolant fluid at the input of the second exchanger 2. Point A8 schematizes the state of the coolant fluid at the output from the accumulation device 8. The variation of enthalpy in the second exchanger 2 marked by the reference Q2, is representative of the second thermal power Pw2 supplied. The level of expansion provided by the first expansion valve 31, schematized by the vertical distance between the point A1*b* and the point A2*a*, makes it possible to adjust the condensation temperature of the coolant fluid in the second exchanger 2, and thus to adjust the second thermal power Pw2.

The second expansion valve 32 expands coolant fluid until it is in a low-pressure state. Point A32*a* illustrates the state of the coolant fluid upstream from the second expansion valve 32, and point A32*b* illustrates the state of the coolant fluid downstream from the second expansion valve 32. The coolant fluid at low pressure evaporates in the third exchanger 3, and reaches the input 7*a* of the compressor 7. The variation of enthalpy between the point A32*b* and the point A7*a* is representative of the thermal power absorbed by the coolant fluid within the third exchanger 3, i.e. during the passage from the input 3*a* to the output 3*b* of the third exchanger 3.

The cross-section of passage of the first expansion valve 31 is controlled by a proportional integral regulator. Similarly, the cross-section of passage of the second expansion valve 32 is controlled by a proportional integral regulator. This type of regulator assures reliable regulation, while remaining simple to program and to adjust. It will be appreciated that other types of regulator can be used.

The step (ii) comprises the following sub-steps:

(ii1) Determining a temperature set point C_T1 of the coolant fluid in the first exchanger 1 from the first thermal power set point C_Pw1 and from a flow set point C_Q1 of the heat-transfer liquid F1; (ii2) Determining a pressure set point C_P1 of the coolant fluid in the first exchanger 1 from the temperature set point C_T1 determined.

Preferably, in step (ii1), the temperature set point C_T1 of the coolant fluid in the first exchanger 1 is also determined from an input temperature T1_*i* of the coolant fluid in the first exchanger 1.

The step (ii1) of determination of a temperature set point C_T1 of the coolant fluid in the first exchanger 1 is based on the fact that the temperature of the heat-transfer liquid F1 after the exchange of heat in the first exchanger 1 and the temperature of the coolant fluid in the first exchanger 1 are correlated.

A temperature set point of the coolant fluid can thus be developed from the temperature to be reached for the heat-transfer liquid F1.

The first thermal power Pw_1 supplied is equal to the flow Q1 of heat-transfer liquid F1 multiplied by the calorific capacity of the heat-transfer liquid F1, and multiplied by the difference between the output temperature of the heat-transfer liquid F1 and the input temperature of the heat-transfer liquid F1 in the first exchanger 1.

Since the input temperature of the heat-transfer liquid F1, i.e. the temperature before the exchange of heat within the first exchanger 1, is known, an objective of output temperature of the heat-transfer liquid F1 can be determined. From there a set temperature C_T1 of the coolant fluid is determined.

According to one embodiment, the temperature of the heat-transfer liquid F1 at the output from the first exchanger 1 is assimilated to the temperature of the coolant fluid in the second exchanger 1.

According to one embodiment, the ratio between the temperature of the heat-transfer liquid F1 at the output from the first exchanger 1 and the temperature of the coolant fluid in the first exchanger 1 is determined according to the flow of heat-transfer liquid F1. For example, the value of the temperature objective of the coolant fluid in the first exchanger 1 can be tabulated according to the temperature of the heat-transfer liquid at the output from the first exchanger 1 and according to the value of the flow of heat-transfer liquid F1. In other words, the ratio between the temperature of the heat-transfer liquid F1 at the output from the first exchanger 1 and the temperature of the coolant fluid in the first exchanger 1 takes into account the thermal efficiency of the first exchanger 1. This efficiency can be characterized for different flows, and stored in a table of the memory of the electronic control unit.

The step (ii2) of determination of a pressure set point C_P1 of the coolant fluid in the first exchanger 1 from the temperature set point C_T1 is based on the characteristic saturation curve of the coolant fluid used. As illustrated in FIG. 5, a pressure of the coolant fluid is associated with each condensation temperature of the coolant fluid.

The step (ii) comprises the following sub-step:

(ii3) Controlling a speed of rotation N of the compressor 7, such that the pressure P1 of the coolant fluid in the first exchanger 1 is equal to the pressure set point C_P1 determined.

Control of the speed of rotation N of the compressor 7 makes it possible to control the pressure of the coolant fluid in the first exchanger 1. In general, an increase in the speed of rotation of the compressor 7 makes it possible to increase the pressure P1 of the coolant fluid in the first exchanger 1.

The pressure P1 of the coolant fluid in the first exchanger 1 can be measured by a measurement sensor positioned at the input of the first exchanger 1. The measurement sensor can also be positioned in the first exchanger 1.

The step (i) comprises the following sub-step:

(i3) Determining a delivery pressure set point C_Pr_d of the compressor 7 from the determined pressure set point C_P1 of the coolant fluid in the first exchanger 1.

Step (ii) comprises the sub-step:

(ii1) Controlling a speed of rotation N of the compressor 7, such that the delivery pressure Pr_d of the compressor 7 is equal to the delivery pressure set point C_Pr_d determined.

According to an embodiment of the method, the pressure of the coolant fluid in the first exchanger 1 is substantially equal to the delivery pressure Pr_d of the compressor 7. In other words, the loss of load between the output 7*b* of the compressor 7 and the first exchanger 1 is thus negligible, and the pressure set point C_P1 of the coolant fluid in the first exchanger 1 is transposed into a delivery pressure set point C_Pr_d of the compressor 7.

According to another embodiment of the method, the pressure P1 of the coolant fluid in the first exchanger 1 is for example estimated from a value measured of the delivery pressure Pr_d of the compressor 7. In other words, the difference between the delivery pressure Pr_d of the compressor 7 and the pressure P1 of the coolant fluid in the first exchanger 1 is taken into account.

Figure 2:
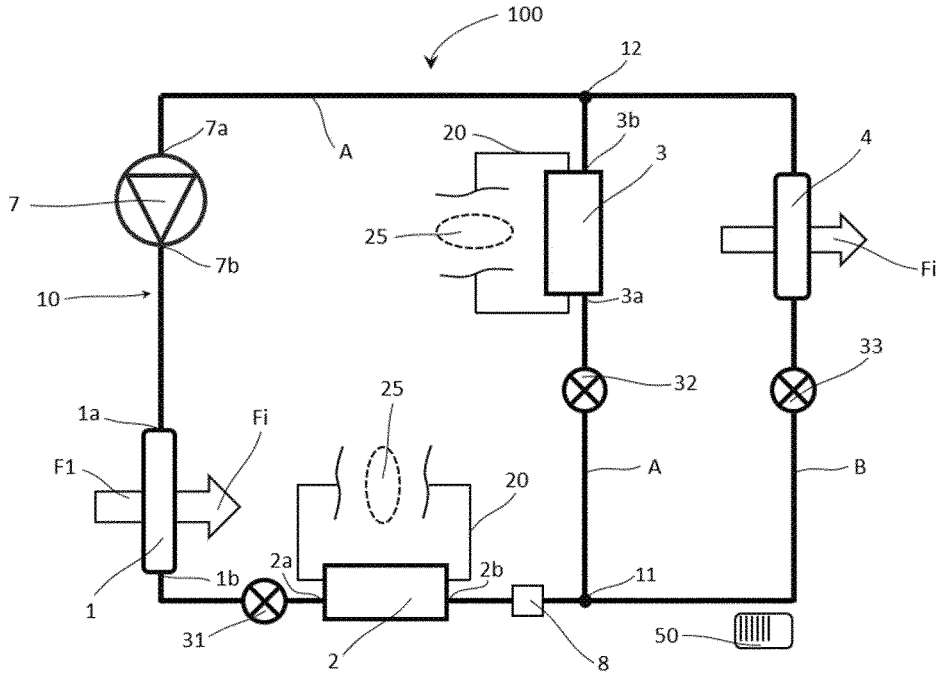
FIG. 2 is a schematic view of a thermal conditioning system according to a second embodiment, in which the control method according to the invention is implemented.

FIG. 2 shows a second embodiment of the thermal conditioning system 100. The coolant fluid circuit 10 comprises a first branch B positioned in parallel with the second expansion valve 32 and the third heat exchanger 3. The first branch B comprises a third expansion valve 33 and a fourth heat exchanger 4.

In other words, the thermal conditioning system 100 comprises a first branch B which connects fluidically a first connection point 11 positioned on the main loop A downstream from the second exchanger 2, and upstream from the second expansion valve 32, to a second connection point 12 positioned on the main loop A downstream from the third exchanger 3 and upstream from the compressor 7. The first branch B comprises a third expansion valve 33. The third expansion valve 33 is positioned upstream from the fourth exchanger 4.

In the example illustrated, the fourth heat exchanger 4 is configured to exchange heat with a flow of air Fi inside the passenger space of the vehicle. The fourth heat exchanger 4 is positioned in the heating, ventilation and/or air conditioning installation. The first heat exchanger 1 is positioned downstream from the fourth exchanger 4 in a direction of flow of the interior flow of air Fi. The fourth exchanger 4 makes it possible to cool the passenger space, with the first exchanger 1 for its part making it possible to heat the passenger space.

Figure 4:
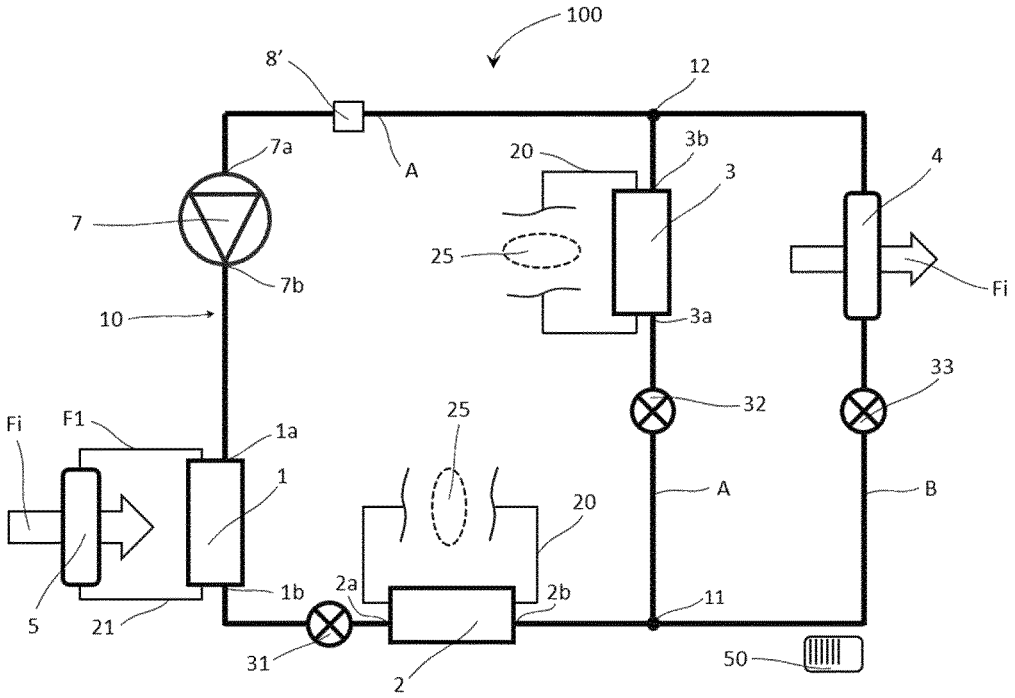
FIG. 4 is a schematic view of another variant of the thermal conditioning system of FIG. 2.

FIG. 4 illustrates a variant of the second embodiment. According to this variant, the heat-transfer liquid F1 is a heat-transfer liquid which is configured to circulate in a fifth heat exchanger 5, configured to exchange heat with a flow of air Fi inside the passenger space of the vehicle.

The fifth heat exchanger 5 is positioned on a second heat-transfer liquid circuit 21. The passenger space is thus heated indirectly, since the condensation heat of the coolant fluid is firstly transferred to the heat-transfer liquid of the circuit 21, and the heat of the heat-transfer liquid is then transferred to the flow of interior air Fi at the fifth exchanger 5. A pump, not represented, can circulate the heat-transfer liquid in the circuit 21. The role of the other exchangers is the same as in the embodiment of FIG. 2. The heat-transfer liquid circuit 21 for heating of the passenger space, and the heat-transfer liquid circuit 20 for the thermal coupling with the element 25 of the transmission chain are separate, i.e. they do not communicate. The fifth exchanger 5 is positioned in the heating, ventilation and/or air conditioning installation. In the embodiments where the fourth exchanger 4 is present, the fifth exchanger 5 is positioned downstream from the fourth exchanger 4 in a direction of flow of the interior flow of air Fi.

Figure 3:
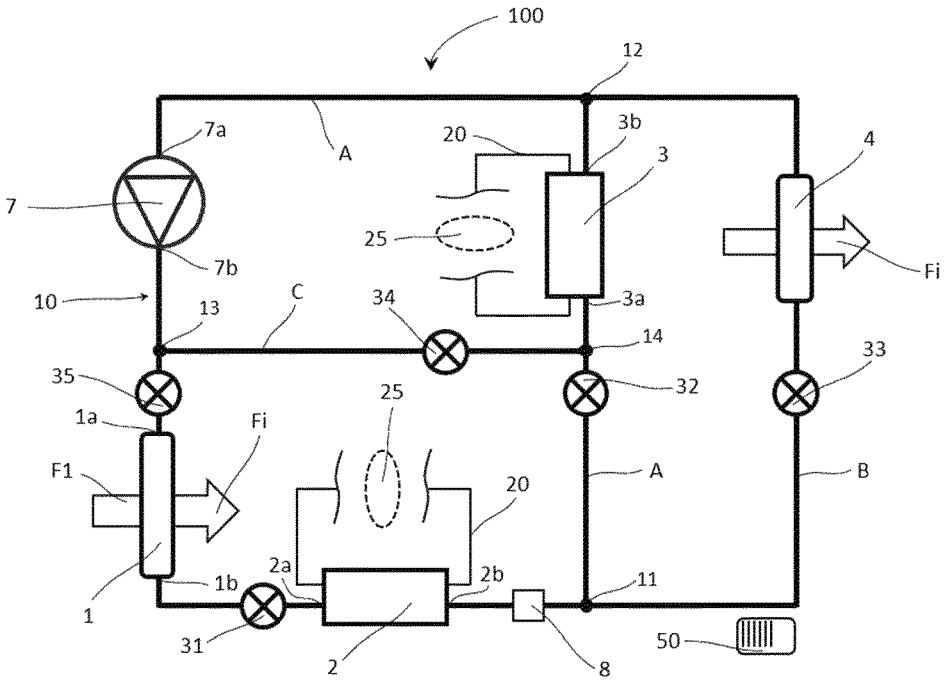
FIG. 3 is a schematic view of a variant of the thermal conditioning system of FIG. 2.

FIG. 3 shows a third embodiment of the thermal conditioning system 100. The coolant fluid circuit 10 comprises a second branch C which allows the coolant fluid at the output from the compressor 7 to reach the third exchanger 3 by bypassing the first exchanger 1, the second exchanger 2 and the second expansion valve 32.

The second branch C comprises a fourth expansion valve 34. The fourth expansion valve 34 is configured to vary a cross-section of passage of the coolant fluid in the second branch C.

In other words, the thermal conditioning system 100 comprises a second branch C which connects fluidically a third connection point 13, which is positioned on the main loop A downstream from the compressor 7 and upstream from the first exchanger 1, to a fourth connection point 14, which for its part is positioned on the main loop A downstream from the second expansion valve 32 and upstream from the third exchanger 3. The second branch C comprises a fourth expansion device 34. The fourth expansion valve 34 is configured to vary a cross-section of passage of the coolant fluid in the second branch C.

In this embodiment, the flow of coolant fluid at high pressure at the output from the compressor 7 is divided between a first flow which circulates in the main loop A, and a second flow which circulates in the second branch C, with the division into two flows being carried out at the third connection point 13. The first flow of coolant fluid circulating in the main loop A is condensed partly in the first exchanger 1 by yielding heat to the heat-transfer liquid F1, it undergoes partial expansion in the first expansion valve 31, and condenses in the second exchanger 2. If the third expansion valve 33 is in the closed position, all of the flow of coolant fluid which exits from the second exchanger passes through the second expansion valve 32, since the flow in the first branch B is zero. The first flow of coolant fluid is thus expanded by the second expansion valve 32, and reaches the fourth connection point 14.

The second flow of coolant fluid, circulating in the second branch C, undergoes expansion at the fourth expansion valve 34. The second flow of coolant fluid is in the superheated vapor state. This flow of superheated vapor circulating in the second branch C is mixed, at the fourth connection point 14, with the flow of liquid coolant fluid or biphasic fluid circulating in the main loop A. The flow of superheated vapor circulating in the second branch C is controlled such that the mixture obtained is in entirely gaseous form at the output from the third exchanger 3, i.e. also in the form of superheated vapor. The reliability of the compressor 7 is thus assured.

When the third expansion valve 33 is in the open position, the first flow of coolant fluid, which circulates in the main loop A downstream from the second exchanger 2, is divided at the first connection point 11 into a third flow circulating in the main loop A which reaches the second expansion unit 32, and a fourth flow circulating in the first branch B which reaches the fourth heat exchanger 4. In this case, the coolant fluid at the output from the fourth exchanger 4 reaches at the second connection point 12 the flow of coolant fluid coming from the third exchanger 3. The total flow of coolant fluid reaches the input 7*a* of the compressor 7, and a new cycle begins.

In the third embodiment illustrated in FIG. 3, the main loop A of the coolant fluid circuit 10 comprises a fifth expansion valve 35 positioned downstream from the compressor 7 and upstream from the first exchanger 1. The coolant fluid is expanded by the fifth expansion valve 35, and the pressure of the coolant fluid in the first exchanger 1 is lower than the delivery pressure Pr_d of the compressor 7. Since the delivery pressure of the compressor 7 is increased, the energy which is received by the coolant fluid is itself increased, which makes it possible to increase the total thermal power supplied by the thermal conditioning system.

The pressure P1 of the coolant fluid in the first exchanger 1 is estimated from a value measured of the pressure of the coolant fluid at the output from the fifth expansion valve 35.

According to the variant of FIG. 4, the main loop A of coolant fluid comprises a device 8' for accumulation of coolant fluid positioned downstream from the third exchanger 3 and upstream from the compressor 7. The device 8' for accumulation of coolant fluid is a coolant fluid accumulator. This variant can also be applied to the first embodiment as well as the third embodiment.

Also, the second branch C can be present without the first branch B being present. This variant has not been represented.

The invention claimed is:

1. A method for controlling a thermal conditioning system, the thermal conditioning system comprising:

a heat-transfer liquid circuit which is configured to circulate a heat-transfer liquid; and a coolant fluid circuit comprising in succession in a direction of flow of the coolant fluid:

a compressor, a first heat exchanger which is configured to supply a first thermal power to a heat-transfer liquid, a first expansion valve, a second heat exchanger arranged jointly on the coolant fluid circuit and on the heat-transfer liquid circuit, so as to supply a second thermal power to the heat-transfer liquid, a second expansion valve, and a third heat exchanger;

the control method comprising:

receiving a total thermal power set point to be supplied, the total thermal power set point to be supplied being a sum of a first thermal power set point to be supplied to the heat-transfer liquid in the first exchanger, and a second thermal power set point to be supplied to the heat-transfer liquid in the second exchanger;

controlling a pressure of the coolant fluid in the first exchanger, wherein the sum of the first thermal power supplied and the second thermal power supplied is equal to the total thermal power set point to be supplied; and controlling a cross-section of passage of the first expansion valve wherein the second thermal power supplied by the second exchanger is equal to the second thermal power set point to be supplied.

2. The control method as claimed in claim 1, further comprising:

receiving a temperature set point of the coolant fluid in the first exchanger, which is based on the first thermal power set point and a flow set point of the heat-transfer liquid; and determining a pressure set point of the coolant fluid in the first exchanger from the temperature set point.

3. The control method as claimed in claim 2, further comprising controlling a speed of rotation of the compressor, wherein the pressure of the coolant fluid in the first exchanger is equal to the pressure set point determined.

4. The control method as claimed in claim 2, wherein the compressor is configured to make the coolant fluid go from an aspiration pressure to a delivery pressure, the control method further comprising determining a delivery pressure set point of the compressor from the determined pressure set point of the coolant fluid in the first exchanger.

5. The control method as claimed in claim 4, further comprising:

controlling a speed of rotation of the compressor, wherein the delivery pressure of the compressor is equal to the delivery pressure set point determined.

6. The control method as claimed in claim 1, wherein the heat-transfer liquid is a flow of air inside a passenger space of a motor vehicle.

7. The control method as claimed in claim 1, wherein the heat-transfer liquid is a heat-transfer liquid which is configured to circulate in a fifth heat exchanger configured to exchange heat with a flow of air inside a passenger space of a vehicle.

8. The control method as claimed in claim 1, wherein the second heat exchanger is coupled thermally with an element of a traction chain of a vehicle, by the heat-transfer liquid of the heat-transfer liquid circuit.

9. The control method as claimed in claim 1, wherein the third heat exchanger is coupled thermally with an element of a traction chain of a vehicle, by the heat-transfer liquid of the heat-transfer liquid circuit.

10. A thermal conditioning system comprising:

a heat-transfer liquid circuit which is configured to circulate a heat-transfer liquid;

a coolant fluid circuit comprising:

a main loop, comprising in succession in a direction of flow of the coolant fluid:

a compressor;

a first heat exchanger which is configured to supply a first thermal power to a heat-transfer liquid;

a first expansion valve;

a second heat exchanger which is arranged jointly on the coolant fluid circuit and on the heat-transfer liquid circuit, so as to supply a second thermal power to the heat-transfer liquid;

a second expansion valve; and a third heat exchanger; and an electronic control unit which is configured to implement the control method as claimed in claim 1.

11. The thermal conditioning system as claimed in claim 10, wherein the coolant fluid circuit comprises a first branch positioned in parallel with the second expansion valve and the third heat exchanger, wherein the first branch comprising a third expansion valve and a fourth heat exchanger, and wherein the fourth heat exchanger is configured to exchange heat with a flow of air inside a passenger space of a vehicle.

12. The thermal conditioning system as claimed in claim 10, wherein the coolant fluid circuit comprises a second branch which allows coolant fluid at an output from the compressor to reach the third exchanger by bypassing the first exchanger, the second exchanger and the second expansion valve, with the second branch comprising a fourth expansion valve.

* * * * *